United States Patent [19]

Monson

[11] 4,159,070

[45] Jun. 26, 1979

[54] IMPACT NAILING ARRANGEMENT

[75] Inventor: Franklin A. Monson, Glen Arm, Md.

[73] Assignee: AAI Corporation, Cockeysville, Md.

[21] Appl. No.: 892,800

[22] Filed: Apr. 3, 1978

Related U.S. Application Data

[63] Continuation of Ser. No. 815,402, Jul. 13, 1977, abandoned, which is a continuation of Ser. No. 753,150, Dec. 21, 1976, abandoned, which is a continuation of Ser. No. 616,974, Sep. 26, 1975, abandoned.

[51] Int. Cl.[2] ..... B25C 1/00; B25C 1/04; B25C 1/12

[52] U.S. Cl. ..... 227/10

[58] Field of Search ..... 227/8, 9, 10, 11

[56] References Cited

U.S. PATENT DOCUMENTS

| | | | |
|---|---|---|---|
| 1,365,869 | 1/1921 | Temple | 227/9 |
| 1,984,117 | 12/1934 | Davis | 227/8 |
| 2,166,041 | 7/1939 | Cox | 227/9 |
| 3,497,124 | 2/1970 | Temple et al. | 227/10 |
| 3,565,312 | 2/1971 | Temple et al. | 227/9 |
| 3,902,238 | 9/1975 | Monson | 227/10 X |

*Primary Examiner*—Roy Lake
*Assistant Examiner*—Paul A. Bell
*Attorney, Agent, or Firm*—Reginald F. Pippin, Jr.

[57] ABSTRACT

An impact nailing arrangement having a nail with integral pointed target-penetration and securing forward section, rear hammer section, and medial compression shear section, the forward section having a threaded object-securing surface rearwardly of its pointed forward target-securing end. The nail is propelled into a target in the preferred embodiment by any one of several illustrated latent energy means, and the forward section is secured by initial point penetration and subsequent compression shear of the medial shear section to enable the hammer section to impart a secondary securing impact to the forward section. Various alternative propulsion arrangements including electrical actuation of a powder charge, spring actuation, and valved pressurized gas, are disclosed.

4 Claims, 11 Drawing Figures

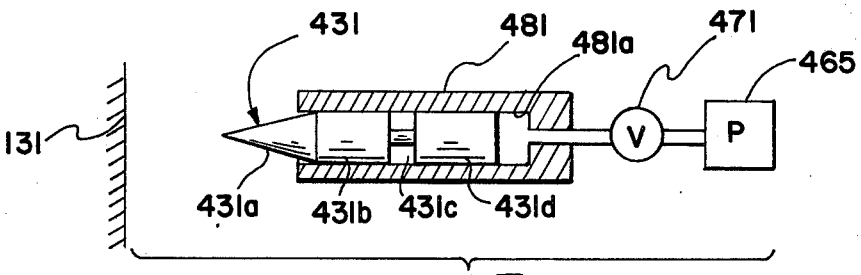
FIG.7
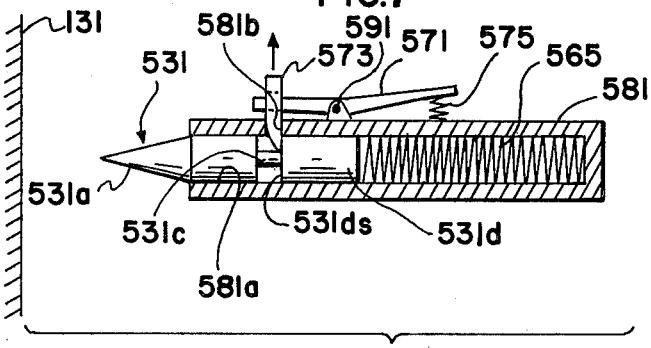
FIG.8
FIG.9
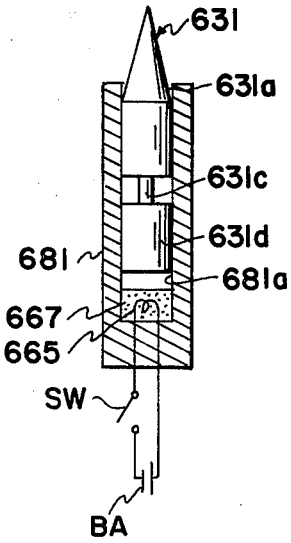

IMPACT NAILING ARRANGEMENT

This is a continuation of application Ser. No. 815,402, filed July 13, 1977, now abandoned which in turn is a continuation of application Ser. No. 753,150, filed Dec. 21, 1976, now abandoned which is a continuation of Ser. No. 616,974 filed Sept. 26, 1975, now abandoned.

This invention relates to nailing arrangements, and more particularly to impact nailing arrangements providing a self-reacting secondary impact by a nail unit to a penetrator section thereof after initial impact and penetration of a target by the penetrator section.

A primary feature and object of the invention is the provision of a nailing or stapling arrangement and staple or nail which enables the imparting of a self-operated secondary impact for improved fastening to a target.

Still other objects, features and attendant advantages will become apparent to one skilled in the art from a reading of the following detailed description of a preferred embodiment constructed in accordance with the invention, taken in conjunction with the following drawings wherein.

Figure 5:
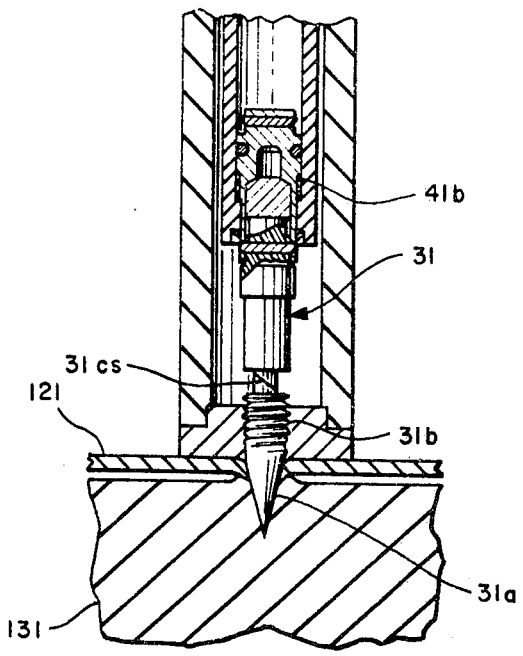
Figure 6:
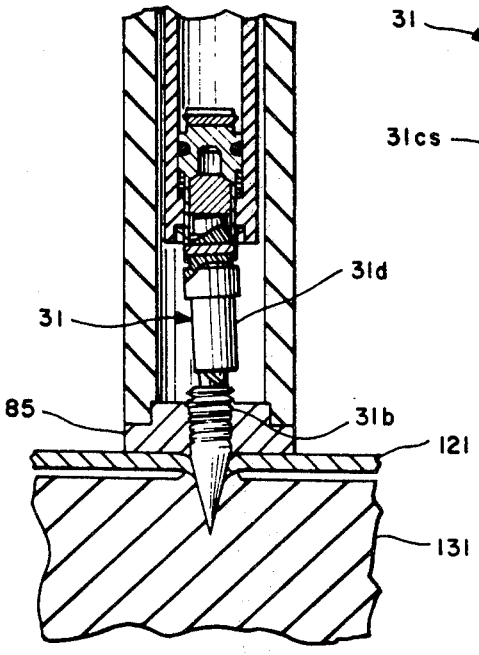
Figure 5A:
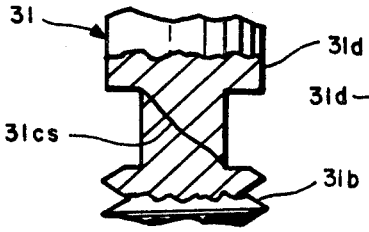
Figure 6A:
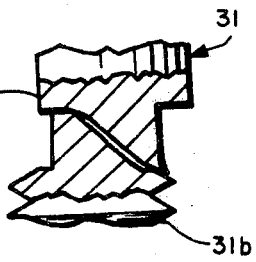

FIGS. 5*a* and 6*a* are enlarged views in partial section of the medial shear section of the nail during operation of the arrangement, and corresponding to the shear rupture and secondary self-impacting conditions illustrated respectively in FIGS. 5 and 6.

FIGS. 7–9 are schematic illustrations of various modifications according to the invention, FIG. 7 being a fluid pressure activated arrangement, FIG. 8 a spring activated arrangement, and FIG. 9 being an electrically initiated powder charge activated arrangement.

Referring now in detail to the FIGS. in the drawings, a nail cartridge arrangement according to a preferred embodiment of the invention to generally indicated in the embodiment of FIGS. 1–6 by the reference numeral 11, and includes a cartridge barrel 13 having a frangible seal 15, and within the bore 13*a* of which is disposed a nail or impact penetrating connector stud generally indicated at 31, which in turn is secured as by a retaining pin 39 to a pusher piston generally indicated at 41. Pusher piston 41 is in turn connected through a shear pin 49 to a propellant cup base 51 which is threadedly secured in the rear end of barrel 13, and which houses a percussion primer 53 and charge of ignitable propellant mix 55.

The cartridge 11 is removably secured within the bore 81*a* of a hand-held holder 81 which is closed at one end by closure member 85, formed of material such as steel, or other material suitable to enable member 85 to serve as a jam washer or nut portion of a threaded unit connection with the nail or stud 31. Closure 85 is press-fit into the lower open end of holder 81, and may be removed in the course of firing and securing of the nail or stud to a target sheet or thereafter by simply rocking the holder 81 after target securement. To this end, the closure 85 has a central recess 85*b* on its interior face, which recess is preferably of sufficient cross section to accommodate passage of the smooth pointed penetrator section 31*a* of the nail or stud 31 and of less diameter than the outer thread diameter of a threaded securing section 31*b* rearward of the tapered point 31*a*. A puncturable closure membrane 85*a* is formed across the bottom of the recess 85*b*, and is punctured by the nail or stud 31 in the course of firing the cartridge 11, the walls of recess 85*a* then engaging with threaded securing section 31*b*.

Securing the cartridge 11 within the holder 81 is suitably effected by set screws 91 which engage with the exterior of the cartridge 11 rearwardly of a damping and center ring 16. A guide 87, with O-ring seals 89, may be secured over the area of set screws 91, through the medium of a set screw 93, thereby affording a substantially water-tight seal at this point between the bore 81*a* of the holder 81 and the exterior of the holder, and enabling the device to be more advantageously used underwater if so desired.

Figure 1:
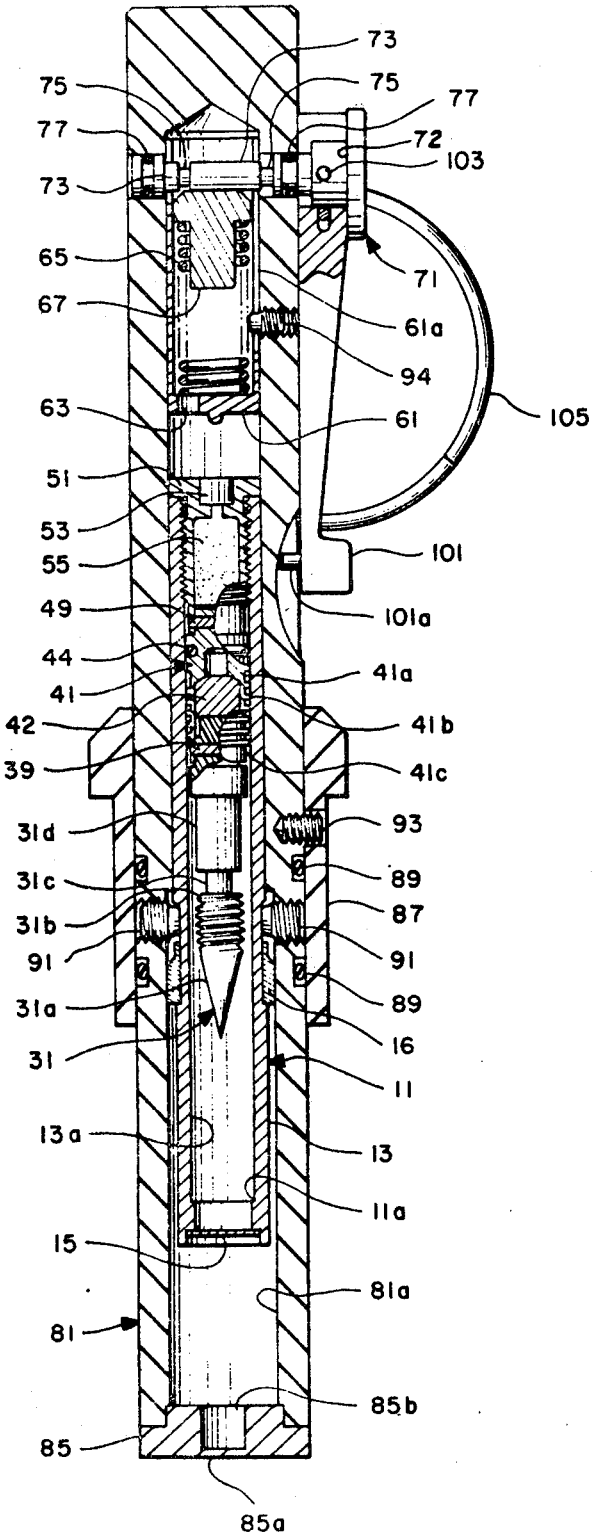
FIG. 1 is a longitudinal section view of a nailing arrangement embodying the invention.
Figure 2:
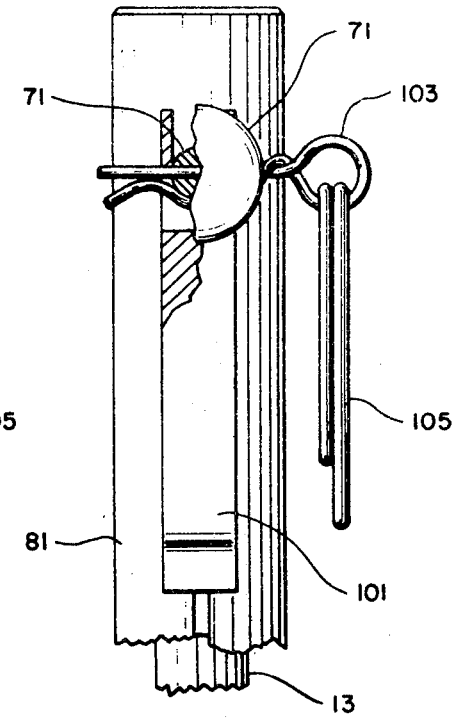
FIG. 2 is a fragmentary side view of the upper section of the arrangement of FIG. 1, taken as viewed from the right hand side of FIG. 1

Disposed rearwardly of the cartridge 11 in the bore 81*a* is a firing pin which is held in the cocked position, as shown in FIG. 1, against the action of compression spring 65, through the medium of a retention/release pin 71. The retention/release pin 71 is held slid the retention position by a safety handle 101 which longitudinally slidably engages therewith from the lower side, the safety handle 101 having a bifurcated end which extends between the enlarged head of the pin 71 and the exterior body of holder 81 to prevent movement of the pin toward the holder 81 until removal of the handle is effected preparatory to firing. A safety pin 103 extends through lateral holes in pin 71 and handle 81, and may be selectively removed by exerting a pulling force thereon with a pull ring 105, after which the safety handle may be slide downwardly along the holder 81 for removal. In the normal safety position, the safety handle is prevented from being angularly moved about the axis of pin 71, through engagement of a pin 101*a* on the safety handle with a guide slot on the outer surface of the holder 81.

Figure 3:
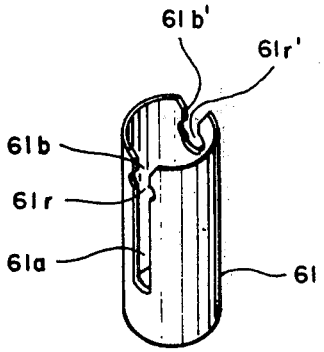
FIG. 3 is an enlarged view in perspective of the firing pin in the arrangement of FIG. 1.

The actuator retention/release pin 71 retains the firing pin 61 in the cocked position by engagement of retention sections 73 thereof with enlarged release holes 61*r*, 61*r*'; formed in the opposite walls of cup-shaped firing pin 61, these retention holes being best seen in FIG. 3, and the retaining relationship being illustrated in FIG. 1. Immediately adjacent the retention sections 73 of pin 71 are reduced neck release sections 75, which are of sufficiently small diameter to pass freely through release slot sections 61*b*, 61*b*'formed in the upper end of the cup-shaped firing pin 61, to thereby enable the firing pin to move downwardly upon the movement of the release pin 71 to the left by a small incremental extent after removal of the safety handle 101. The reduced neck release sections 75 are caused to be in registry with the release slots 61*b*, 61*b*' by engagement of the underside of the flanged head of release pin 71, which forms a shoulder stop 72 on the release pin 71 with the exterior surface of handle 81 when the pin 71 is moved to the left, as viewed in FIG. 1. O-ring seals 77 may be employed adjacent the internally opposite ends of pin 71 to afford water-tight sealing of the interior bore 81*a* of handle 81.

Upon registry of the reduced neck release sections 75 of pin 71 with the enlarged retention holes 61*r*, 61*r*', the firing pin will move forward under the influence of the compression spring 65, being guided in this respect by a set screw guide pin 94 which slidably engages with guide slot 61*a* formed as a lower extension of release slot 61*b* and enlarged retention hole 61*r* in the firing pin 61. The firing pin 61 may have one or more fluid bypass orifices 63 formed in its forward end to enable fluid pressure equalization, and thereby enable full utilization of the firing pin force exerted by compression spring 65.

Upn impacting of the firing pin 61 with the primer 53 the propellant mix 55 will be ignited to effect shearing of the shear pin 49 and movement of the pusher piston 41 and nail or stud 31 downward as viewed in FIG. 1, it being appreciated that the reference to direction as being downward is only with respect to the Figure and does not indicate that the device will or must be fired in any given position. The device is capable of operating in ay orientation relative to a given target to which it is desired to secure the nail or stud 31 and closure nut member 85.

Pusher piston 41 has formed on its outer annular surface a series of sealing and shear stop rings 41*b* which are separated by annular grooves 41*a*, these rings and grooves serving the dual purpose of aiding in sealing the propellant gases and also enabling final energy absorbing stopping and retention of the pusher piston 41 within the forward end of cartridge 11. To this end, there is formed at the forward end of bore 13*a* in cartridge barrel 13 a shoulder stop 11*a* which enables the free passage therepast of the nail or stud 31, while engaging the shear stop rings 41*b*, thereby causing the rings 41*b* to be sheared as the pusher piston 41 attempts to move therepast, the number of rings being sufficient to absorb the remaining energy in the pusher piston 41 after nail or stud 31 is secured to the target, and to retain the pusher piston within the cartridge barrel 13 at the end of the firing sequence.

As noted hereinfore, the nail or stud 31 is formed with a penetrator section 31*a* which takes the preferred form of a smooth tapered securing point 31*a*rearwardly of which is a threaded securing section 31*b* which is of substantially constant thread diameter along its length, to thereby simulate athreaded stud end when the nail or stud 31 is embedded in a target sheet, with the threaded securing section, 31*b* protruding on the exterior of the target. The nail or stud 31 is formed as an integral unit with a rear hammer section 31*d* connecting with the forward penetrator section 31*a* and threaded securing section 31*b* through a reduced diameter shear section 31*c*. A plug 42 may be employed, if desired, rearwardly of hammer section 31*d* to absorb shock and forward motion force between the hammer section 31*d* and pusher piston 41.

The reduced diameter shear section 31*c* is formed with a sufficient diameter to provide the necessary column strength between the penetrator and threaded nut or washer-securing section 31*a*, 31*b* on the one hand and the hammer section 31*d* on the other hand, to insure that the necessary precise force is imparted from the pusher piston 41 to the penetrator section 31*a* to afford desired penetration of the penetrator section 31*a* into a target sheet. With a high tensile steel target (e.g. 100,000 psi ultimate tensile strength), a desired and proper extent of penetration by a point having a length of 0.45 inch and a rear diameter of 0.230 inch, has been found to be approximately 0.35 inch. To effect this extent of penetration, using a one-piece high-strength steel (e.g., maraging steel 300) nail or stud 31, a diameter of approximately 0.150 inch for the frangible section has been found satisfactory, with a 0.280-inch diameter hammer section 31*d* and threaded securing section 31*b* thereadjacent. A nominal chemical analysis for maraging steel 300 has been given as Carbon: 0.03 max.
Silicon: 0.10 max
Manganese: 0.10 max.
Sulfur: 0.010 max.
Phosphorus: 0.010 max.
Nickel: 18.50
Cobalt: 9.00
Molybdenum: 4.80
Aluminum: 0.10
Titanium: 0.60
Boron: 0.003
Zirconium: 0.02 added
Calcium: 0.05 added As to physical properties, its ultimate tensile strength is approximately 300,000 psi, with a compressive strength of 0.2% offset, a yield, aged, of 317,500 psi, and a shear strength of 150,000 psi. After the proper depth of penetration of point 31*a* has been effected during initial impact, increased resistance by the target to further point penetration causes the frangible reduced diameter shear section 31*c* to fail in compression shear, and the hammer section 31*d* will continue forward to impart a further secondary impact to the rear of the integral point and threaded securing sections 31*a*, 31*d*, as illustrated in FIGS. 5 and 6 respectively, as well as enlarged FIGS. 5*a* and 6*a*, the shear rupture zone being indicated schematically at 31*cs*, FIGS. 5 and 5*a* being schematically illustrative of the secondary impacting effected as a result thereof, by the hammer section 31*d*.

Figure 4:
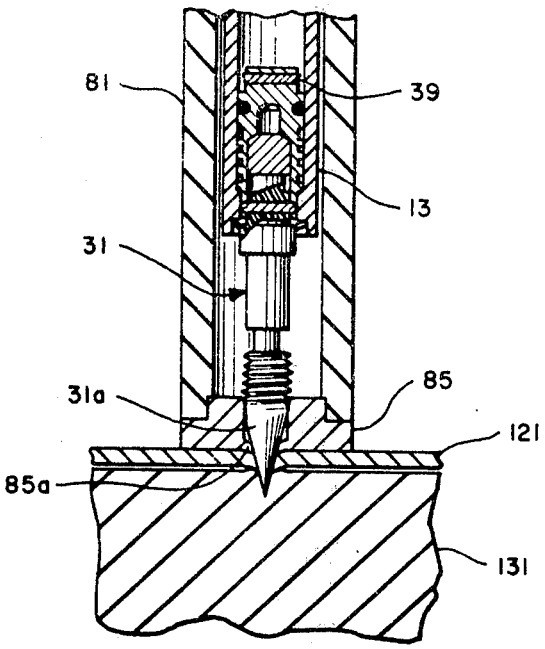
FIGS. 4, 5 and 6 are schematic section views illustrating sequential steps in the operation of the arrangement of FIG. 1 in securing the nail or stud according to the invention, to a target plate.

As will be seen from FIGS. 4–6, the penetrator section 31*a* of nail or stud 31 passes through closure membrane 85*a* and the object, such as a metal sheet 121, which is to be attached to a target plate 131, causing lateral displacement of each of the closure membrane 85*a*, the metal object sheet 121 and the metal target plate 131, an effective degree of penetration being illustrated in FIGS. 5 and 6, at which point the threaded section 31*b* is in radial jam engagement with the walls of closure member recess 85*b*, and the smooth tapered point section 31*a* is engaging with the metal sheet 121 and the target plate 131. At this position, the resistive forces of the target plate 131 are sufficient to overcome the column strength of the shear section 31*c*, thereby effecting the shear rupture as indicated at 31*cs*. The remaining kinetic energy of the pusher piston 41 and the hammer section 31*d* will thereupon cause the hammer 31*d* to effect a secondary impact on the rear end of the penetrator and threaded securing sections 31*a*, 31*b*, to thereby prevent the penetrator point section 31*a* from bouncing out of its penetration contact with the target 131, and also affords a further securing action at the point of contact with the point section 31*a* and the target 131. The thus embedded point is effectively secured with the target plate, being frictionally secured and apparently to some extent welded to the target material. It has been found that with an arrangement of this nature the nail may be effectively secured to withstand an axial pull of approximately 6,000 pounds, and such has been successfully used as a fastener to mild steel, 4130 steel, HY80 steel, and HY100 steel, in thicknesses ranging from ⅜ inch to effectively infinite thickness.

While the invention has been illustrated and described with respect to a single preferred embodiment in FIGS. 1–6A, it will be apparent that various modifications and improvements will be made without departing from the scope and spirit of the invention. For instance, while in the foregoing illustrative embodiment there is disclosed a particular means for actuating the latent energy means, it is not necessary that such be a part of the manufactured apparatus, nor that such be sold or furnished to a user with such an actuating means. The actuating means may be added or supplied later at time of use, or actuation may be accomplished manually, as with a manually wielded hammer or other impact, electrical, chemical reaction, or other desired type of device, which might suitably fire or otherwise actuate a primer, propellant charge, spring, or other latent energy means. Various separate auxiliary apparatus, both mechanical and electrical, for firing or otherwise actuating primers, propellant charges, etc., or other latent energy means, are well known, as in the ordnance art, and are not necessary to be described for an understanding of this invention as to scope or manner of alternative practice thereof by one skilled in the art. While the illustrative embodiment employs latent energy means in the form of ignitable propellant, it will be appreciated that other latent energy means might suitably be employed, such as a spring as shown in the embodiment of FIG. 8., a chemical composition or compositions which generate useful energy such as gases and/or heat upon selective chemical reaction as in FIG. 9, or a selectively releasable stored pressurized gas, as in FIG. 7, etc. Further, as will be apparent from the foregoing illustrative modification embodiments according to the invention, while a specific illustrative embodiment has been illustrated in FIGS. 1–6A and described, with specific respect thereto, and has been found to be a desirable and workable embodiment, and while various detailed features of such embodiment may themselves be additionally novel and inobvious, the broad invention of my double impact nailing arrangement impact-compression shearable double impact nail unit, either as a total arrangement or as novel and inobvious subcombination useful for nailing, either clearly does not require the particular structural arrangement of the illustrative embodiment such as the sealed barrel 13, hand-held holder 81, cartridge 11, pusher 41, primer-ignited propellant powder latent energy means 55, safety firing pin arrangement 63, 73, 75, 101, 105, or energy-absorbing shear ring arrangement 41*b*, 11*a*. For example, for normal use outside of underwater use, a sealed barrel is not necessary. Also, a single support means may be utilized in lieu of the separate barrel and holder of FIG. 1, and the required linear motion may be imparted directly to the nail unit, without use of a pusher 41.

Also, the position or precise form of the various parts in a given particular embodiment is not critical for practice of the broad aspect of the invention as claimed. For example, referring to the particular illustrative embodiment, while the igniting means does occupy a position within the support means formed by cartridge 11 and barrel 13 in the illustrative arrangement of FIG. 1 as it is vertically disposed, it not only need not be above the latent energy means when the portable arrangement of FIG. 1 is moved to a different position, but neither it nor the latent energy means need be within the support means, as various and sundry other arrangements may be provided, including arrangements where the igniting means or both the igniting means and propellant charge latent energy means is external of and/or has no specific relation to the support means.

By way of illustration of the foregoing various alternative modifications according to the invention, FIGS. 7–9 illustrate various alternative constructions. It will be appreciated that various ones of these embodiments and the embodiment of FIG. 1, may be utilized on targets of various materials, such as aluminum, mild steel, concrete, copper, high strength steels, and wood, particularly hard woods such as maple, oak and gum, and it is not necessary or even necessarily desirable that the target be formed of any particular material, although it will be further appreciated that in the embodiments employing potential large value latent energy means, such as the embodiment of FIG. 1 the invention may find its most advantageous utilization in attachment of a nail unit to a target of relatively tough and rigid material, such as described more specifically with respect to the embodiment of FIG. 1. Examples of materials which might be suitably employed as targets for the modification embodiments of FIGS. 7–9 are mild steel, aluminum, hard wood, etc. The invention is not, however, limited to attachment of nail units to such tough or rigid materials, and all embodiments are not equally applicable to attaching of a nail unit to such tough rigid materials, although it will be appreciated that the basic and fundamental aspects of the invention are common to and practiced with all embodiments.

A smooth section such as indicated at 431*b* in FIG. 7 may be employed, in lieu of a threaded surface section, if desired, rearward of the tapered point end of the penetrator section particularly in those instances where it is anticipated that the total penetration will not be greater than the tapered point end 431*a*, and securement will be effected by the tapered point end 431*a*, as in those instances where a washer or other element is secured to the target 131 by the tapered point end 431*a* being in partial engagement therewith after completion of penetration, or where the nail unit itself is simply imbedded into a target 131.

In the embodiment of FIG. 7, the nail unit 431 is driven into a target 131 through the medium of a latent energy means in the form of a gas pressure source 465 which connects through the medium of a selectively actuable valve 471 with a support means 481 in the form of a barrel having a bore 481*a* within which the nail unit 431 is slidably supported. The gas pressure source 465 may be suitably pressurized either by an inert prepressurized gas inserted therein, or such may be pressurized otherwise, such as through the medium of a chemical reaction process between suitable chemical reactants. For a nail unit 431 of similar material (i.e., maraging steel 300) and medial shear section diameter (i.e., approximately 0.15 inch) it is only necessary that the pressure be sufficient to generate a propulsive force of approximately 4,000 pounds to achieve a point penetration in a similar target of approximately 0.32 inches, and with shear rupture of the medial section 431*c*. For this purpose various conventional chemical reactants may be employed which are capable of yielding a sufficient ultimate pre-release pressure P to effect this force at release, as for instance a pressure P of approximately 5,000 psi for a one-inch diameter nail unit hammer section 431*d* rear end surface. Such chemical reactants may be either fast or slow acting, and may be self- or externally initiated, including percussive, electrical, catalyst, or other initiation or actuation. The nail unit penetrator section suitably includes a tapered point end 431*a*, rearward of which is a smoothly cylindrical, or threaded, knurled, or otherwise roughened section 431*b* (section 431*b* being illustrated as smoothly cylindrical for purpose of illustration), connecting through a medial shear section 431*c* with a cylindrical hammer section 431*d*. In operation, the selectively actuable valve 471 may be suitably opened in order to enable the gas pressure from the latent energy means gas pressure source 465 to enter the bore 481*a* and propel the nail unit 431 against a target 131 for embedment thereinto. The nail unit 431 may be frictionally slidably held within the bore 481*a*, or may be lightly slidably press-fit thereinto if so desired, and the support means 481 may be held in any desired position including vertical, horizontal, etc. dependent upon the degree of frictional self-retention or other retention of the nail unit 431 within the bore 481*a*, as may be desired. The line interconnecting the gas pressure source 465 may be flexible or rigid; or the gas pressure source 465 and value 471, with interconnecting line, may be integral with support 481, as may be desired or suitable for a given instance of use. The illustration is schematic in nature. If greater gas sealing ability is desired between the nail unit 431 and the bore 481*a*, conventional obturator action may be employed, as by formation of a conventional or other desired obturator flange on the hammer section 431*d* or otherwise on the nail unit 431, for enabling increased gas sealing between the nail unit 431 and the support means bore 481*a* as a function of gas pressure acting on the rear of the nail unit 431.

In the embodiment of FIG. 8, a nail unit 531 similar to that of nail unit 431 of FIG. 7, is slidably held within bore 581*a* of a fixed or portable support means in the form of a barrel 581. The nail unit is releasably held within the bore 581*a* through the medium of a sear 571 laterally slidable through an aperture 581*b* extending through the side wall of the barrel 581. The sear 573 engages with the forward shoulder 571*ds* of the hammer section 531*d*, and may rest against the medial shear section 531*c* in the loaded and retained condition of the nail unit 531. An actuator lever 581 connects with the sear 573 as by a slot connection, and may be suitably pivotally mounted on a pivot support fork 591 secured to or formed on the barrel support means 581. A compression spring 575 may be employed to exert a torque on the actuator lever so as to resiliently bias the sear 573 transversely inwardly within the aperture 581 into a retentive engagement with the shoulder 531*ds* of the nail unit 531. The latent energy means in this illustrative embodiment takes the form of a compression spring 565 which is suitably compressed to a desired latent energy condition upon inserting of a nail unit 531 within the bore 581*a*. Various conventional springs of various sizes and corresponding compression degrees may be employed. For instance, in the previously discussed examples where a nail unit 531 of maraging steel 300 is employed, with a medial shear section 531*c* of approximately 0.15 inch, with a target penetration of approximately 0.32 inch, it is necessary to provide a cocked spring force of approximately 4,000 pounds. It will be readily apparent to one skilled in the art that the size and compression of a spring may be varied to achieve this end, and this computation of such for a given material, such as spring steel, is a straightforward simple design problem, not requiring specific example for spring size and compression. Manual actuation of the actuator lever 571 by pivoting of the lever about the pivot support 591 and against the compression spring 575 effects lateral release movement of the sear 573 to thereby release the nail unit 531, whereupon the nail unit 531 is propelled under the released stored latent energy action of the compressed compression spring 565, for travel to the target 131 and impacting therewith by the tapered point end 531*a*.

The embodiment of FIG. 10 is similar in construction and mode of operation to that of FIG. 7, with barrel support means 681 carrying a nail unit 631 having a tapered point end 631*a*, a medial shear section 631*c* and a hammer section 631*d*. An electrically ignitable propellant mass 667 may be formed or secured at the base of the barrel 681, either on a one-time use basis or on a removable cartridge basis, such being illustratively shown as a simple mass of propellant mix formed in place at the base of the bore. An electrical igniter 665 may be suitably electrically connected between a switch Sw and a battery BA, for selective closure of the switch Sw at the time of desired actuation of the propellant mix 667. The electrical igniter 665 may be suitably coated with conventional initiation assisting compound for assisting in actuation of the propellant mix in those instances where it is desirable to use a propellant mix which is of low sensitivity to direct intiation by an electrical igniter.

Still further modifications and improvements may be made without department from the scope and spirit of the invention. Accordingly, the invention is not to be limited by the illustrative embodiment, but only by the scope of the appended claims.

I claim:

1. An arrangement for enabling impact nailing, comprising guide means, a nail unit adapted to be directionally oriented by said guide means, and latent energy means disposable in energy-transmitting relation to said nail unit when said nail unit is disposed in said guide means for imparting linear motion to said nail unit, said nail unit having a forward penetrator section, a hammer section and a medial impact-compression shear section between said penetrator section and said hammer section, and which impact-compression shear section is impact-shearable as a function of energizing said latent energy means and resultant linear motion impacting of said penetrator section with a target object to which it is desired to be attached, said latent energy means comprising propellant gas means, said propellant gas means comprising a supply of propellant gas under static pressure, and selective control means for releasing such gas for forward propelling action on said nail unit.

2. An arrangement for enabling impact nailing, comprising guide means, a nail unit adapted to be directionally oriented by said guide means, and latent energy means disposable in energy-transmitting relation to said nail unit when said nail unit is disposed in said guide opening for imparting linear motion to said nail unit, said nail unit having a forward penetrator section, a hammer section and a medial impact-compression shear section between said penetrator section and said hammer section, and which impact-compression shear section is impact-shearable as a function of energizing said latent energy means and resultant linear motion impacting of said penetrator section with a target object to which it is desired to be attached, said latent energy means comprising a spring.

3. An arrangement according to claim 2, said spring being disposed in actuating alignment with said nail unit.

4. An arrangement according to claim 3, said guide means having a guide bore for guiding said nail unit, said spring being disposed in said bore.

* * * * *